United States Patent [19]

Schwarz

[11] Patent Number: 4,965,975

[45] Date of Patent: Oct. 30, 1990

[54] MEANS FOR ERECTING A WALL OF WALL BLOCKS, PREFERABLY OF GLASS

[76] Inventor: Willi Schwarz, Wittland 5, 2300 Kiel 1, Fed. Rep. of Germany

[21] Appl. No.: 319,571

[22] Filed: Mar. 6, 1989

[30] Foreign Application Priority Data

Feb. 23, 1989 [DE] Fed. Rep. of Germany ..... 8902153

[51] Int. Cl.[5] ..... E04B 1/40; E04B 2/20; E04C 1/42

[52] U.S. Cl. ..... 52/308; 52/477

[58] Field of Search ..... 52/308, 477, 307

[56] References Cited

U.S. PATENT DOCUMENTS 2,140,998 12/1938 Hohl ..... 52/477
2,239,537 4/1941 Owen ..... 52/308
2,282,964 5/1942 Hohl ..... 52/477
2,413,268 12/1946 Unverferth ..... 52/306
4,058,943 11/1977 Sturgill ..... 52/477

*Primary Examiner*—James L. Ridgill, Jr.
*Attorney, Agent, or Firm*—Brown, Martin, Haller & McClain

[57] ABSTRACT

Means for erecting a wall of preferably disc-like wall blocks, particularly glass blocks, having marginal support portions adjacent the wall surfaces limiting the bearing sides of the blocks, an offset surface being located between the support portions. A flat strip is located between the offset surfaces of superimposed or adjacent wall blocks which is made preferably of tension material. Support pieces are connected to the flat strip or are integrally formed therewith, the support pieces having a suitable support section adapted to be located between superimposed or adjacent support portions.

9 Claims, 2 Drawing Sheets

MEANS FOR ERECTING A WALL OF WALL BLOCKS, PREFERABLY OF GLASS

The invention refers to means for erecting a wall, preferably of disc-like wall blocks, particularly of glass.

PRIOR ART

Due to static conditions, sealing circumstances or the like, wall blocks of glass are not placed directly one upon the other. Therefore, it is known to place plaster between the blocks. By this, joints occur at the support and abutting surfaces having a width of at least 10 mm. The erection of a wall with glass blocks and plaster has many disadvantages. The plaster joints form so-called thermal bridges which reduce the total thermal insulation of a wall of glass blocks. The acoustic damping is also affected by plastered joints. Due to the bad thermal insulation condensed water may occur at the internal side of the wall which may lead to the formation of fungicide. A further disadvantage is the low adhesion between the glass block and the plaster. Small cracks are formed in the plaster joint which due to a capillary effect favor the penetration of water. In case of frost, the plaster joint may be burst open. The light transmission through a wall of glass blocks is reduced by the plaster joints. The optical impression of a wall erected of plastered glass blocks is negatively influenced by the plaster joints.

SUMMARY OF THE INVENTION

The object of the invention is to provide means for the erection of a wall of preferably disc-like wall blocks, particularly of glass blocks which allow a simple positioning of the blocks one above the other without the use of plaster. This object is attained by the features of claim 1.

Usually glass blocks consist of two shells interconnected at the open side thereof. The shells have disc-like portions which extend beyond the support and the abutting sides of the glass blocks so that a fillet extends between the parallel discs of a glass block. A flat hollow space is defined by two glass blocks superimposed wherein, according to the invention, a flat strip is received. It is generally known in connection with glass blocks to place flat strips, e.g. of steel, in the plastered support joint. The flat strip serves as armor and is to increase the strength in the support joint. In the invention, the flat strip serves as retaining means for support pieces which have a support section adapted to be positioned between the marginal support portions of adjacent glass blocks. The support portions of glass blocks are defined by the narrow surfaces of the disc portions. The disc portions are supported by the support sections which in turn are connected to the flat strip. According to the invention, the support sections of the support pieces which engage the protruding marginal portions of the glass blocks are either formed at the ends of the support pieces or, alternatively, are defined by thicker ends of the support pieces. The support pieces according to the invention can be effectively placed between the ends of a fillet of a glass block in the support or abutting joint and are safely retained therein. The support pieces, further, can be located beyond the joints of adjacent glass blocks, whereby the flat end portions of the fillet are overbridged which are to be disregarded with respect to support purposes. The support sections of the support pieces safely engage the fillet of adjacent glass blocks whereby the flat strips are relieved from any bending forces.

According to an embodiment of the invention, the support sections are convex on both sides in cross section. By this, a corresponding adaptation is achieved at the transient range between the offset surface or bottom of the fillet and the associated margin of the marginal support portions.

According to a further embodiment of the invention, plate-like webs of the support pieces have two parallel ridges at the side opposite to the flat strip. The ridges receive the seams extending beyond the bottom of the fillet through which both shells of a glass block are interconnected. The ridges effect an additional guidance for the support pieces.

The flat strip can be formed such that the support sections or support pieces, respectively, are integrally formed. In this case, the means are preferably of plastic material. Alternatively, the support pieces can be separately formed parts, preferably of suitable plastic material, which at predetermined intervals are adapted to be connected to the flat strip.

By the flat strips provided with the support pieces extending along the support joint of a plurality of wall blocks, a stable compound of the wall blocks is achieved without necessitating a plastering or adhering for static reasons. It is understood that the means according to the invention can be also used in the area of abutting joints which is particularly advantageous for optical reasons to achieve a uniform distance in the area of support and abutting joints.

The support sections are preferably dimensioned such that they are offset with respect to the outer surfaces of the wall blocks. By this, a suitable resilient sealing mass can be brought into the joints which serve for a sufficient sealing of the erected wall.

By use of means according to the invention for erecting a wall of glass blocks, a plurality of advantages is achieved. By the means according to the invention, the join width is strongly reduced so that by this, the thermal insulation is improved. The use of a suitable sealing mass of plastic material, e.g. silicone, has a smaller thermally conducting coefficient than for instance plaster. Therefore, the formation of condensed water at the inner side of the wall is avoided. Since a sealing can be established in two parallel planes, it can be detected at any time whether leakages have occurred. A means according to the invention results in a smaller width of the joints so that the light transmission is improved. The total optical impression is attractive.

Embodiments of the invention are described hereinafter along drawings.

BRIEF OF THE DRAWINGS

FIG. 1 is a cross-sectional view of two glass blocks placed one above the other by support piece according to the invention;

FIG. 2 is a cross section through FIG. 1 along line 2—2 in diminished scale;

FIG. 3 shows a similar view as FIG. 2 of a modified embodiment according to the invention;

FIG. 4 is a top plan view of the arrangement of FIG. 3 with the uppermost glass block removed, and illustrating a series of blocks on which support pieces as illustrated in FIG. 3 have been laid;

DESCRIPTION OF THE FIGURES

The support piece shown in the figures is a one piece member having small marginal strips 10,11 at its opposite edges and retaining portions 12,13 having opposed, inwardly facing grooves 60,62 extending adjacent the respective marginal strips. The grooves serve for receiving opposite side edges of a flat strip 12, preferably of steel, which is seated on plate-like portion 23 extending between the retaining portions 12,13.

The U-shaped profile of the retaining portions 12, 13 form lower and upper engaging sections which are convex in cross section, the regions of the engaging sections 15, 16, 17 and 18 at the opposite longitudinal ends of the support piece are different from the engaging regions 20, 21 therebetween. The engaging regions 15 to 18 which are formed at opposite sides, the lower engaging sections being interconnected through a plate-like portion 23 are thicker than the engaging regions 20,21 as seen in FIG. 2. The engaging sections 13 define towards the marginal strips 10, 11 which form the support sections a relatively flat engaging surface 24 while the engaging sections 15 to 18 form a thicker curved engaging surface 25. Rectangular openings 25 and **26*a* are formed in the plate-like portion 23 adjacent the retaining portions 12, 13**.

Plate 23 has two parallel spaced ridges 32, 33 on the outer side thereof forming a groove into which the welding seam 31 of the lower glass block 50 extends. Therefore, the ridges 32, 33 form an additional guidance and retaining means for the support piece between adjacent glass blocks.

Figure 1:
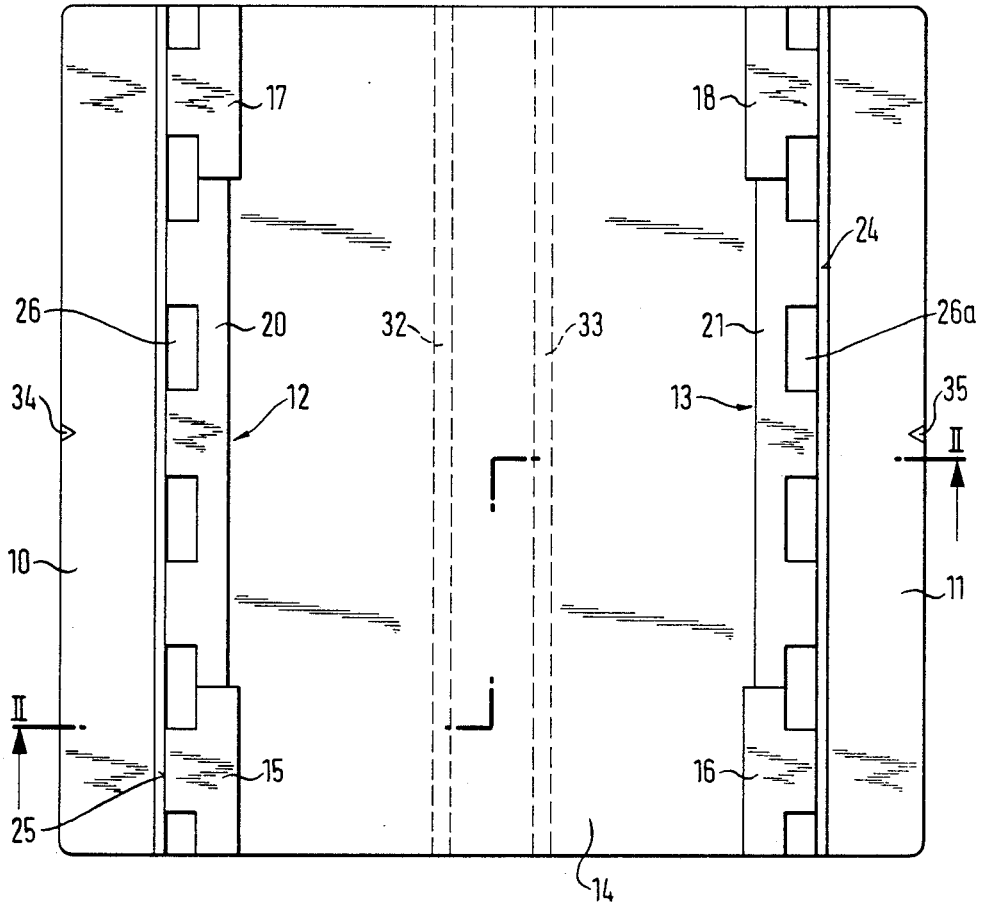
Figure 2:
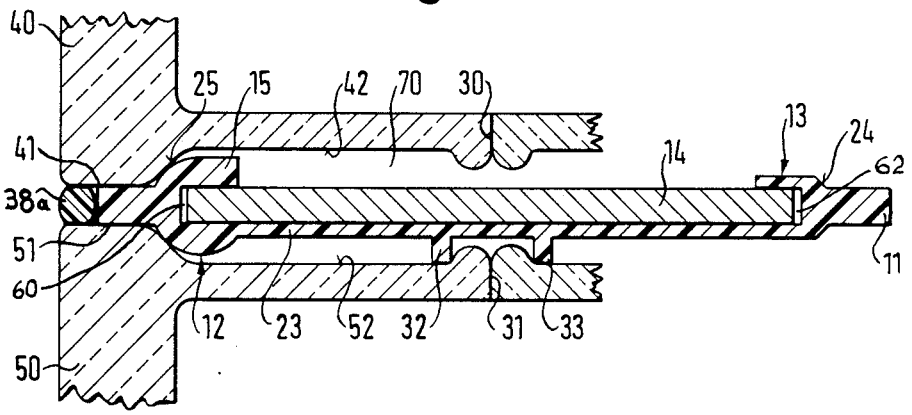
In FIG. 2 two glass blocks 40, 50 superimposed are indicated having a conventional structure and are composed of two interconnected shells, the open sides of the shells being connected through a welded seam 30 which is elevated outwardly. The shape of the shells results in protruding marginal support portions 41, 51 adjacent the outer surface and in offset surfaces 42, 43. The offset surfaces 42, 52 form a flat cavity 70 into which a flat strip 14 is placed. It can be seen that the support portions 41, 51 engage the marginal strips 10,11, the engaging sections 15 to 18 being adapted to the transient area between the marginal support portions 41, 51 and the offset surfaces 42, 52. By this, a support piece can be effectively centered between adjacent glass blocks 40, 50 by means of the engaging sections 15 to 18. The retaining portions 24 between the engaging sections 15 to 18 have a smaller thickness and, thus, are loosely located between the offset surfaces 42, 52. Therefore, these retaining sections of smaller thickness can also be placed in the areas of the offset surfaces 42, 52 which approach the height of the marginal support portions 41, 51. This is the case at the ends of the glass blocks. The fillet defined by the offset surfaces 42, 52 has a transient area between the offset surfaces and the marginal portions 41, 51 and is more shallow toward the ends of the glass block. In case an engaging section 15 to 18 would be placed in this area, the load would not be overtaken by the support sections 10, 11, rather by the engaging sections. The configuration of the support pieces shown thus enables a placement of the support pieces overbridging the joints of adjacent glass blocks.

As can be seen in FIG. 1, a notch 34, 35, respectively, is formed in the edge of the support portions 10, 11 in the mid-length thereof. It serves for the orientation of the support pieces with respect to the center of a joint if located across the joint of adjacent glass blocks.

Figure 3:
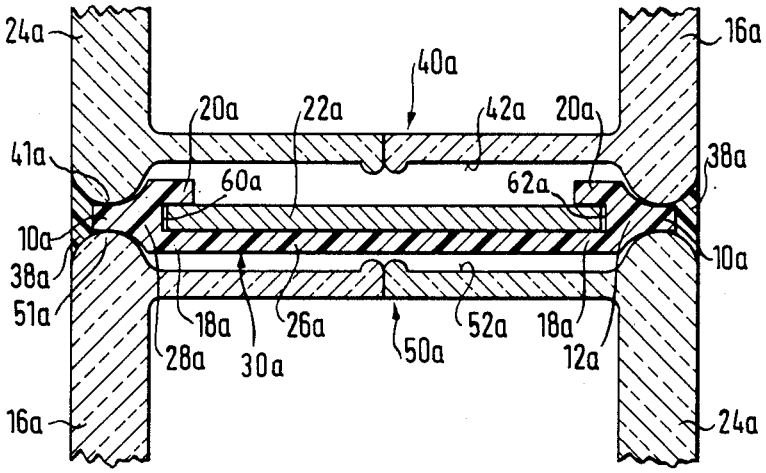
Figure 4:
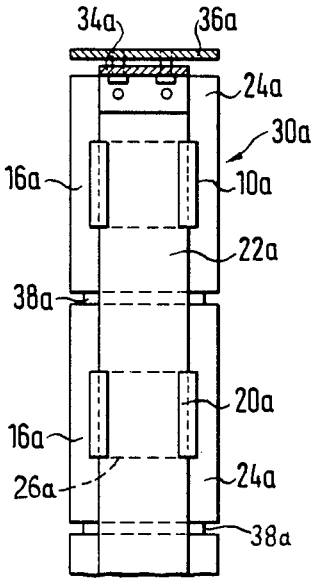

FIG. 3 shows two glass blocks **40*a*, 50*a* one above the other having a conventional structure and consisting of two interconnected shells. Curved support portions 41*a*, 51*a* adjacent the external side of the wall are formed with offset surfaces 42*a*, 52*a* therebetween. The offset surfaces 42*a*, 52*a* form a flat space or cavity wherein a flat strip 22*a*, e.g. of plastic material, steel, aluminum or the like is placed. It extends along a series of glass blocks, e.g. along the total wall as indicated in FIG. 4. Its width corresponds approximately to the width of the offset surfaces 42*a*, 52*a***.

The strip is received in a plurality of spaced support pieces **30*a* as can be seen in FIG. 4. For example, one support piece 30 is provided per pair of superimposed glass blocks. The support pieces 30*a* have support sections 10*a* at the ends thereof which are located between superimposed support portions 41*a*, 51*a*. The support sections 10*a* terminate at a distance from the external surface 16*a*, 24*a* of the blocks 40*a*, 50*a* By this, a space is left into which an elastic sealing mass 38*a* can be brought. The support sections 10*a* are integrally formed with retaining sections 12*a*, 28*a* which have inwardly facing, opposed grooves 60*a*, 62*a* which face towards one another to receive the opposite side edges of strip 22*a* and which are U-shaped in cross section. The upper leg 20*a* of the retaining section 12*a*, 28*a*, respectively, can be interrupted by gaps at interval so that the flat strip 22*a* can be pushed in more simply. The lower legs 18*a* of the retaining section 12*a*, 28*a*, respectively, are interconnected through a web 26*a* at the lower side of the flat strip 22*a*, the web 26*a* extending over the length of the support piece 30*a***.

As can be seen, the external transient area from support section **10*a* to retaining section 12*a*, 28*a* is rounded so that an adaptation to the cross-sectional contour of the blocks 40*a*, 50*a* is achieved. By this, an automatic centering of a strip 22*a* and the support piece 30*a*** is accomplished. The worker solely has to place this arrangement on the support side of the blocks from above whereby it automatically attains the correct position.

To secure the flat strip **22*a* at its ends, it can be appropriate to connect it with an angled piece 34*a* as can be seen in FIG. 4 which in turn is connected to a frame 36*a***, e.g. by screws, the frame enclosing the wall erected by the glass blocks.

What is claimed is:

1. An assembly for erecting a wall of preformed glass wall blocks, comprising:

support means for extending between the adjoining faces of each adjacent pair of blocks in the wall;

each support means comprising a support member of plastic material of length less than the length of a wall block, the support member having a marginal support portions extending along its opposite edges, and a flat, elongated strip longer than said support member slidably mounted on said support member, said support member having retaining portions extending adjacent each of said marginal support portions, said retaining portions having opposed grooves which face inwardly towards one another for slidably receiving the opposing side edge portions of said strip;

said support member being shorter than the distance between opposing wall surfaces of said blocks to leave recesses adjacent the outer wall surfaces at the joints between adjacent blocks for filling with sealing material; and said retaining portions including regions adjacent the opposite ends of said support member which are thicker than the remainder of said retaining portions.

2. The assembly as claimed in claim 1, wherein said engaging means comprises an engaging section provided at each of the four corners of said support member, said support member being of length between 7 to 9 cm, and the length of each engaging portion being between 1 and 3 cm.

3. The assembly as claimed in claim 1, wherein said support member between said opposing grooves comprises a plate-like web for supporting said flat strip, said web having two parallel spaced ridges on its face opposite said flat strip.

4. The assembly as claimed in claim 1, wherein a notch is formed at least in one longitudinal edge of said support portion.

5. The assembly as claimed in claim 1, wherein said support member between said opposing grooves comprises a flat web lying at the lower side of said flat strip.

6. The assembly as claimed in claim 1, wherein said support member has spaced opposite side walls defining at least one of said grooves, at least one of said side walls having gaps at intervals in portions defining at least one side wall of each groove.

7. The assembly as claimed in claim 1, wherein said support member has engaging means on its outer surface at the interface between each support portion and groove for following the contour of a wall block, said engaging means extending along at least part of the length of said support member.

8. The assembly as claimed in claim 7, wherein said engaging means is of convex cross-section.

9. A wall comprising:

a plurality of preformed blocks of glass or the like stacked one on top of the other, the blocks having support portions extending adjacent the wall surfaces;

support means extending between opposing upper and lower faces of each adjacent pair of blocks;

each support means comprising a support member of plastics material of length less than the length of a wall block, the support member having support sections at its opposite longitudinal edges positioned between opposing support portions of said wall blocks, and a connecting web portion which is thinner than said support sections extending between the support sections, and a flat strip of length greater than the length of said support member mounted on said support member;

said support member having opposing retaining means adjacent its support sections for retaining said flat strip, said retaining means having aligned opposing grooves which face inwardly towards one another for slidably receiving the opposite edges of said strip and said retaining means having regions adjacent the opposite ends of said support means which are thicker than the remainder of said retaining means;

each support section being offset inwardly from the outer surface of the wall to leave a recess; and sealing material filling said recess.

* * * * *